United States Patent [19]

Hart et al.

[11] Patent Number: 4,592,480

[45] Date of Patent: Jun. 3, 1986

[54] TAMPER EVIDENCING CONTAINER CAPS

[75] Inventors: James A. Hart, Cockeysville, Md.; R. Keith Jacks, Waukegan, Ill.

[73] Assignee: SCM Corporation, New York, N.Y.

[21] Appl. No.: 565,737

[22] Filed: Dec. 27, 1983

[51] Int. Cl.[4] ..... B65D 17/34

[52] U.S. Cl. ..... 220/270; 220/307; 222/153; 222/541

[58] Field of Search ..... 220/214, 266, 270, 254, 220/306, 307, 339; 222/153, 541, 565, 569

[56] References Cited

U.S. PATENT DOCUMENTS

| | | | |
|---|---|---|---|
| 2,661,128 | 12/1953 | Rieke . | |
| 3,081,011 | 3/1963 | Stull . | |
| 3,095,995 | 7/1963 | Foster . | |
| 3,155,285 | 11/1964 | Van Baarn . | |
| 3,160,325 | 12/1964 | Stull . | |
| 3,251,509 | 5/1966 | Foster . | |
| 3,255,928 | 6/1966 | Foster . | |
| 3,675,812 | 7/1972 | Foster . | |
| 3,883,034 | 5/1975 | Rausing . | |
| 3,942,630 | 3/1976 | Phillips . | |
| 4,463,869 | 8/1984 | Lewis | 220/307 |

*Primary Examiner*—George T. Hall

*Attorney, Agent, or Firm*—Richard H. Thomas

[57] ABSTRACT

A tamper evidencing cap for use with containers for ingestibles, medicines, and the like. The cap comprises first and second cover members connected to each other. At least one lid is hinged to the second cover member for movement between open and closed positions. Tamper evidencing means is removably connected to and between the lid and one of the cover members to prevent the lid from opening until the tamper evidencing means is removed. The cap may additionally or alternatively include a further tamper evidencing means comprising a skirt that extends from the periphery of the first cover member for engaging a side surface of the container. The skirt has a plurality of spaced apart weakened zones around its periphery.

30 Claims, 42 Drawing Figures

TAMPER EVIDENCING CONTAINER CAPS

BACKGROUND OF THE INVENTION

The present invention relates to container caps. More particularly, the invention is directed to a tamper evidencing cap for use with containers for ingestibles, such as herbs, spices, and other powdered food products, medicines in pill or capsule form, etc.

Tamper evidencing packaging is not new to the food industry. For many years products such as beer, wine, and salad-dressing, which are sold in glass bottles, have been packaged with labels or plastic shrink bands wrapped over the cap. Caps used on plastic milk and juice bottles are manufactured with tear-away or break-away bands which must be removed to open the bottle. Products such as breakfast cereal, crackers, and cookies are sold in sealed boxes. However, many food product packages traditionally include no tamper evidencing means, and are therefore highly vulnerable to tampering. These are often inexpensive items whose manufacturers have considered the added expense of tamper evidencing packaging to be cost-ineffective.

One example where it has been an almost industry-wide practice to date not to use tamper resistant or tamper evidencing containers is in the spice industry. Spices are usually sold in powdered, crushed, or flaked form and packaged in lightweight metal or plastic cans with plastic caps. Typically, spice and herb containers have caps with sift holes, a pour hole, or a spoon hole, or a combination thereof, which are covered by one or more hinged, sliding, or rotating lids. The only tamper proof mechanism presently in common use with spice containers is a knock-out panel ocassionally found in the main opening or spoon hole.

Packaging of herbs and spices has changed little over the years. Container caps that were introduced twenty years ago are still in use. Typical examples of spice container caps that can be found on store shelves today are shown in the following U.S. Pat. Nos.: 3,675,812, issued July 11, 1972; 3,469,732, issued Sept. 30, 1969; 3,255,928, issued June 14, 1966; 3,251,509, issued May 17, 1966; and 3,095,995, issued July 2, 1963, all to John A. Foster; 3,542,235, issued Nov. 24, 1970 to Walter E. Hidding; 3,397,823, issued Aug. 20, 1968 to Wylie C. Kirkpatrick; 3,262,606, issued July 26, 1966 to Neil S. Waterman; and 3,155,285, issued Nov. 3, 1964 to Paul S. Van Baarn.

There have been several designs for tamper proof spice container caps developed to date; see, for example, Foster U.S. Pat. Nos. 3,255,928 and 3,251,509. However, lack of consumer interest and cost effectiveness have prevented them from becoming a success in the marketplace. One recent example of a tamper evidencing cap for spice containers is shown in U.S. Pat. No. 4,361,250, issued Nov. 30, 1982 to Foster. This design is limited to container caps including a hinged lid which is bordered on either side by the cap, and cannot be applied to the most common container cap designs. In addition, the small size of the web connectors leaves open to question the practical effectiveness of the visibility to the consumer of the cap's tamper evidencing feature.

The Food and Drug Administration (FDA) has recently promulgated regulations requiring tamper evidencing packaging for drugs sold over-the-counter to consumers. Such packaging must have an indicator or barrier to entry which, if breached or missing, can reasonably be expected to provide visible evidence to consumers that tampering has occurred. Currently available packaging systems considered by the FDA to meet this requirement include film wrappers; blister or strip packs; bubble packs; shrink seals and bands; foil, paper, or plastic pouches; bottle seals; tape seals; breakable caps; sealed tubes and cartons; and aerosol containers.

The FDA is presently considering extending its regulations to include food products. Consequently, the provision of tamper evidencing means for spice containers may soon become not only desirable, but also necessary. However, there are a number of problems associated with the design of a tamper evidencing cap for spice containers.

Tamper evidencing mechanisms used for other kinds of containers, including those accepted by the FDA, and tamper evidencing mechanisms previously proposed for spice containers, have not been suitable for use with the standard cap configurations used in spice containers. Adhesive strip sealing around the cap (a là Tylenol-type packaging) is expensive and makes it difficult to stack and package spice containers in larger shipping containers as well as to stack the containers on store shelves. The knock-out panel used in spoon holes is inconvenient, usually requiring the use of a utensil and considerable force to remove it; often it falls into the container where it cannot be removed. Also, knock-out panels are not suitable for use with small openings, such as sift holes or a pour hole.

A tamper evidencing cap must be easy for the consumer to use, but strong enough to resist breakage or separation from the container due merely to normal handling during manufacture, shipping, storage, and display. Also, the evidence of tampering must be visible to the manufacturer, retailer, or consumer on casual inspection.

Typically, spice containers are stacked for storage and display side by side and one on top of the other. Thus, the relationship between container cap dimensions and the can dimensions is critical. The cap at its widest point must be the same width as the can at its widest point, or the containers will lean over and fall when placed side by side. Also, the top of the container cap must fit inside the bottom of the container can, or the containers will slide and fall when stacked on top of each other. The tamper proof tear strips and other mechanisms that have been proposed or are presently in use on other kinds of containers do not satisfy these dimensional requirements.

The tamper evidencing container cap of the present invention overcomes disadvantages associated with previously known or proposed devices.

SUMMARY OF THE INVENTION

The tamper evidencing container cap of this invention essentially comprises first and second cover members securely connected to each other in such a way as to substantially prevent relative movement between them. At least one lid is hinged to the second cover member and tamper evidencing means is removably connected to and between the lid and one of the cover members to prevent the lid from opening until the tamper evidencing means is removed. Preferably, one edge of the lid is substantially colinear with one edge of the second cover member and the tamper evidencing means is an elongated bar integral with the edge of the lid and at least part of the edge of the second cover member.

In a variation, a second lid is also mounted to the second cover member. Both lids are hinged for pivotal movement about substantially parallel pivot axes. The tamper evidencing bar member may be integrally connected to the colinear edges of the two lids rather than to the one lid and cover member.

In order to maintain the advantageous stackability feature of the present caps, the combined widths of the second cover member and the tamper evidencing bar do not exceed the width of the first cover member. Thus, when the cover members are closed, the bar member does not extend beyond the corresponding edge of the first cover member.

In a further embodiment of, the tamper evidencing container cap of the invention, first and second lids are mounted to the second cover member for movement between open and closed positions. The tamper evidencing means includes first and second tab members, each having at least one weakened zone along its length. The first tab member is integral with the first lid and the first cover member, and the second tab member is integral with the second lid and the first cover member.

The tamper evidencing container cap of this invention may additionally or alternatively include a further tamper evidencing means comprising a skirt that extends from the periphery of the first cover member for engaging a side surface of the container. The skirt has a plurality of spaced apart weakened zones around its periphery. Preferably, the skirt extends downwardly from the first cover member for engaging an interior side surface of the container. The skirt has a horizontal portion extending outwardly from the periphery of the first cover member and a vertical portion extending downwardly from the periphery of the horizontal portion. The weakened zones are incorporated in one or both of the horizontal and vertical portions of the skirt.

BRIEF DESCRIPTION OF THE DRAWINGS

Various objects, features, and attendant advantages of the present invention will be more fully appreciated as the same become better understood from the following detailed description of the present invention when considered in connection with the accompanying drawings, in which.

In the drawings, like reference numerals represent identical or corresponding parts throughout the several views.

DETAILED DESCRIPTION OF THE PREFERRED EMBODIMENTS

Preferred Embodiment I

FIGS. 1–13 illustrate a first preferred embodiment of a tamper evidencing container cap in accordance with the present invention.

Figure 5:
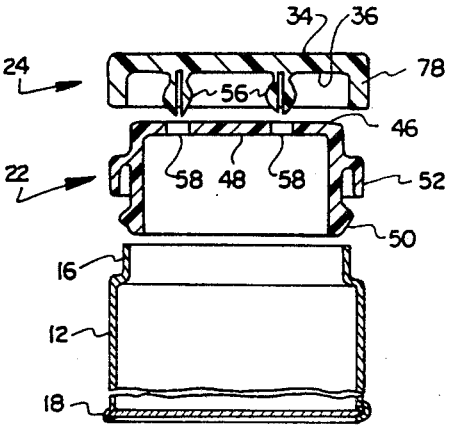
FIG. 5 is an exploded cross-sectional view of the assembly, taken along line V—V of FIG. 1.
Figure 9:
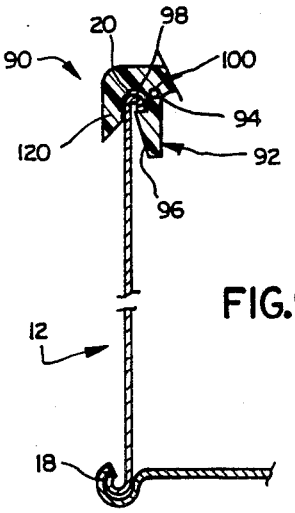
FIG. 9 is a cross-sectional view of a further tamper evidencing feature of the container cap of this invention.

A container, generally indicated by reference numeral 10, comprises a can 12 and a one-piece molded container cap 14. As shown in FIG. 5, can 12 may include an inset neck 16 at its top; a lip or bead 18 extends downwardly and outwardly from its bottom. Alternatively, can 12 may be straight sided at its upper portion and have an in-turned lip or bead 20, as shown in FIG. 9. Can 12 is substantially rectangular in both horizontal and vertical cross section.

Figure 1:
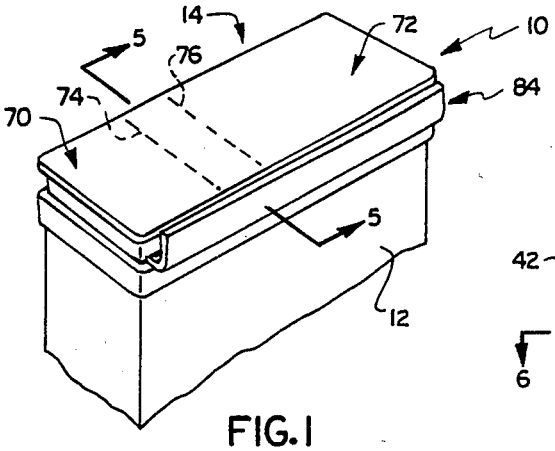
FIG. 1 is a perspective view of one preferred embodiment of the tamper-evidencing container cap of the present invention, assembled and mounted on a can.
Figure 3:
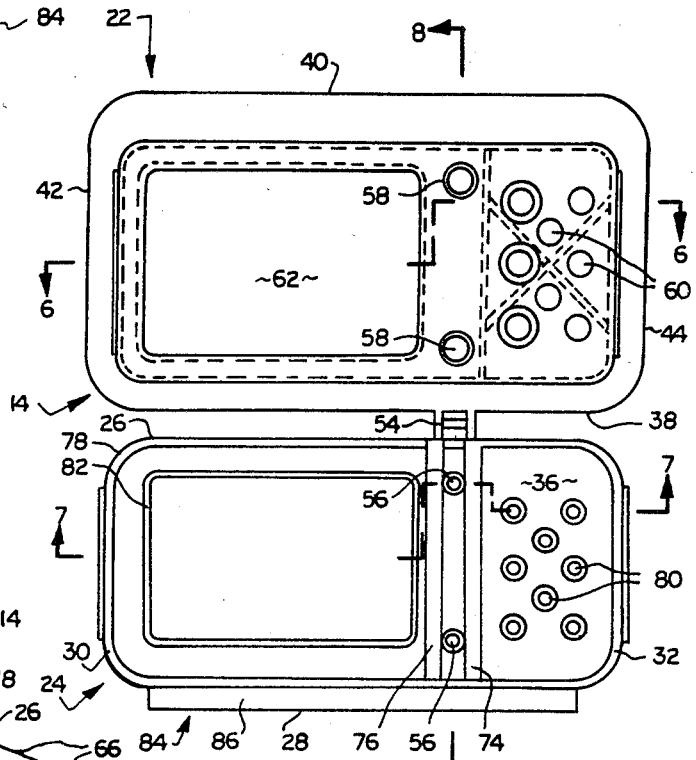
FIG. 3 is a top plan view of the unassembled container cap of the present invention.
Figure 2:
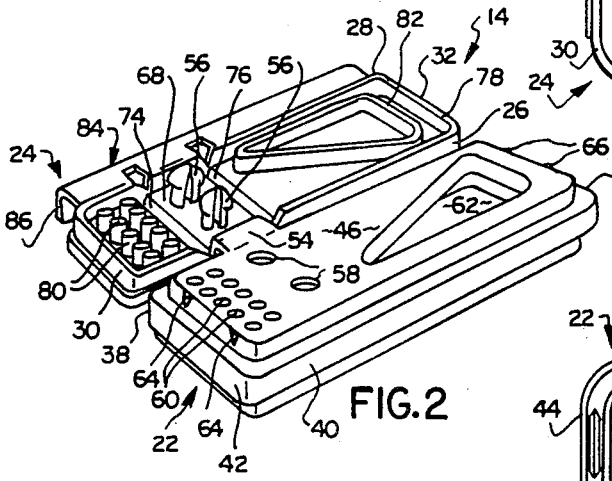
FIG. 2 is a perspective view of the container cap of the present invention, prior to assembly.
Figure 4:
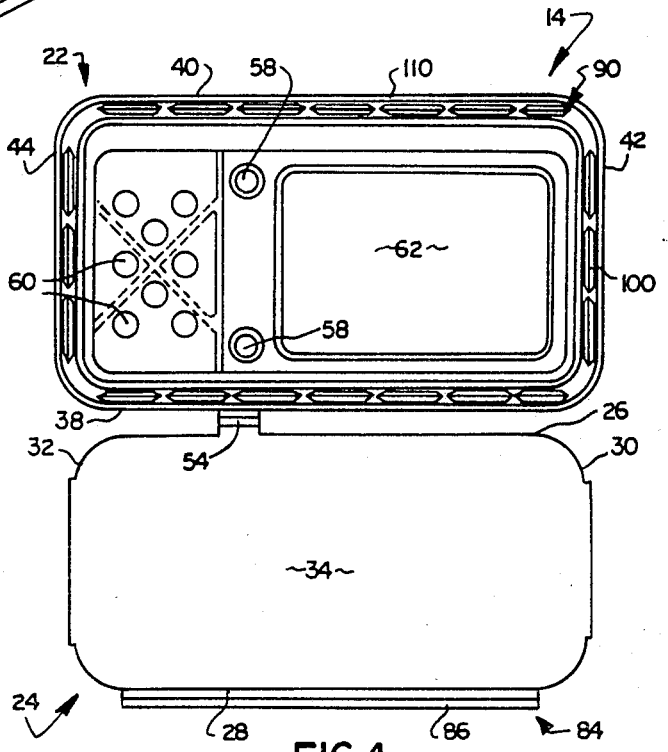
FIG. 4 is a bottom plan view of the unassembled container cap of the present invention.
Figure 6:
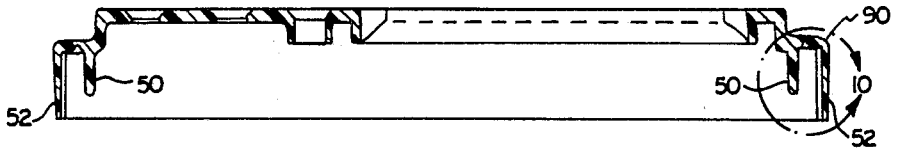
FIG. 6 is a cross-section of the container cap, taken along line VI—VI of FIG. 3.
Figure 8:
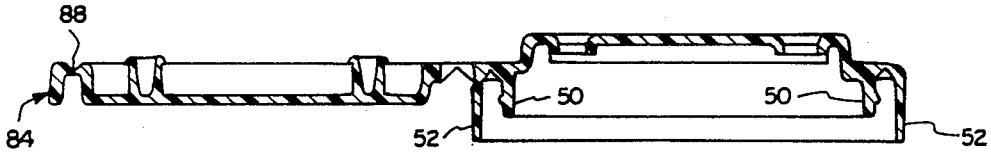
FIG. 8 is a cross-sectional view of the container cap, taken along line VIII—VIII of FIG. 3.

Referring particularly to FIGS. 2–4, container cap 14 comprises a first, or lower cover member 22 for fastening cap 14 to can 12, and a second, or upper cover member 24 for covering lower cover member 22. Cover members 22 and 24 are substantially rectangular. Upper cover member 24 (FIGS. 3, 4) has a back edge 26, a front edge 28, side edges 30 and 32, a top surface 34, and a bottom surface 36. Lower cover member 22 likewise has a back edge 38, a front edge 40, side edges 42 and 44, a top surface 46, and a bottom surface 48. Lower cover member 22 advantageously has an inner skirt 50 and an outer skirt 52 extending around its periphery as shown in FIGS. 6 and 8, for engaging neck 16 of can 12.

It should be understood that terms such as upper, lower, inner, outer, back, front, and sides are chosen arbitrarily, and refer generally to the usual orientation of the container cap and its parts when the container cap is in its assembled and closed position on the can.

Cover members 22 and 24 are preferably formed as a one piece molded unit. Cover members 22 and 24 are connected at their back edges 38 and 26 by one or more living hinges 54. A pair of one-way assembly pins 56 of standard construction extends from bottom surface 36 of upper cover member 22. Pins 56 mate with a pair of assembly pin holes 58 located in lower cover member 22. Assembly pins 56 and assembly pin holes 58 provide mounting means for securely and non-removably mounting upper cover member 24 to lower cover member 22. Assembly pins 56 and assembly pin holes 58 are preferably located on opposite sides of the longitudinal centerline (i.e., a line parallel to and between sides 26, 28 and 38, 40) and to one side of the lateral centerline (i.e., parallel to and between sides 30, 32 and 42, 44) of cover members 24 and 22, respectively.

Lower cover member 22 contains a plurality of sift holes 60, located to one side of assembly pin holes 58, for sifting powdered contents of can 12, and a spoon hole 62, located on the other side of assembly pin holes 58, for spooning the contents of can 12. As illustrated in FIGS. 3 and 4, sift holes 60 can be arranged in alternating, staggered rows (FIG. 2). Alternatively, sift holes 60 can be arranged in pairs of parallel rows. Spoon hole 62, as illustrated in FIG. 2, is substantially triangular. However, it can also be semi-circular, rectangular (FIGS. 3, 4), or any other shape which will accommodate a spoon for spooning the contents from can 12. Cover member 22 also includes protrusions 64 and 66 extending from side edges 42 and 44 (FIG. 2), respectively, for a purpose to be described hereafter.

Figure 7:
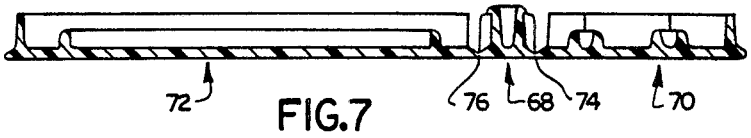
FIG. 7 is a cross-sectional view of the container cap, taken along line VII—VII of FIG. 3.

Upper cover member 24 includes a main body portion 68 (FIGS. 2, 7). Assembly pins 56 are formed on the underside of portion 68. Cover member 24 further includes first and second generally opposed lid portions 70 and 72. When the cap is fully assembled the first, or sift lid 70 covers sift holes 60 in cover member 22; the second, or spoon lid 72 covers spoon hole 62. Lids 70 and 72 are integrally formed with the remainder of the container cap and are connected to main body portion 68 by living hinges 74 and 76 (FIGS. 2, 7), respectively. Hinges 74 and 76 are preferably aligned substantially parallel to each other on opposite sides of main body portion 68. Cover member 24 also includes a seal rim 78 extending peripherally downwardly from edges 26, 28, 30, and 32 of cover member 24. Rim 78 is notched (FIG. 2) adjacent living hinges 74 and 76 to permit sift lid 70 and spoon lid 72 to pivot about hinges 74 and 76. Sift lid 70 and spoon lid 72 are held by protrusions 64 and 66, respectively, against accidental opening when closed. The bottom surface of sift lid 70 may include a plurality of sift hole pins 80 extending therefrom for sealing engagement with sift holes 60. The bottom surface of spoon lid 72 likewise can include a spoon hole seal rim 82 extending therefrom for sealing engagement with the perimeter of spoon hole 62.

Container cap 14 is molded with tamper evidencing means, generally designated 84 (FIGS. 2, 3, 4 and 8), removably connected to sift lid 70 and spoon lid 72. Tamper evidencing means 84 (sometimes referred to as the "lid-to-cap" tamper evidencing means) comprises an elongated bar member or tear strip 86 integral with one side of main body portion 68 and with colinear edges of sift lid 70 and spoon lid 72; bar member 86 thus lies substantially perpendicular to the pivot axes of hinges 74 and 76 and secures lids 70 and 72 against pivotal movement about hinges 74 and 76, respectively. Bar member 86 preferably is L-shaped in cross-section, extending outwardly from the front edges of sift lid 70 and spoon lid 72 and upwardly, substantially even with the top surface 34 of upper cover member 24. Bar member 86 has an elongated weakened zone 88 (see FIG. 8) in the region connecting bar member 86 with lids 70 and 72 which enables it to be easily separated from lids 70 and 72, and from main body portion 68 of cover member 24 when it is desired to open container 10. Alternatively, bar member 86 may have a plurality of spaced apart weakened zones (not shown) in the region connecting bar member 86 with lids 70 and 72.

Upper cover member 24 may be somewhat shorter in length and width than lower cover member 22. Advantageously and preferably, the combined widths of bar member 86 and upper cover member 24 do not exceed the width of lower cover member 22. Thus, when cover members 22 and 24 are closed, bar member 86 preferably does not extend beyond the corresponding edge of lower cover member 22. Cover member 24 is advantageously and preferably dimensioned to fit inside the perimeter of the bead 18 of another similar container, to permit containers to be stacked on top of each other.

Container cap 14 also preferably includes further tamper evidencing means, generally designated 90, incorporated in lower cover member 22. In the embodiment shown in FIG. 9, the further tamper evidencing means 90 (sometimes referred to as the "cap-to-can" tamper evidencing means) comprises a member 92 that extends downwardly from an inner skirt 94. Member 92 has a beveled face 96 and a cap locking face 98. The region defining the joinder of member 92 to inner skirt 94 contains a plurality of weakened zones 100; alternatively, spaced apart webs separated by elongated perforations may be formed in the joinder region. This embodiment is particularly suited for cans with inwardly rolled-over top edges.

Figure 10:
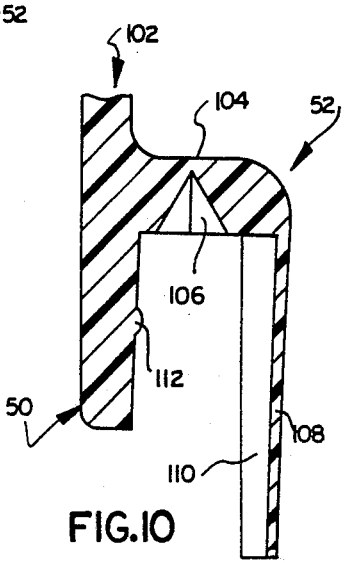
FIG. 10 is an enlarged view of a portion X of the container cap of FIG. 6, showing an alternate further tamper evidencing feature of the container cap.

An alternate cap-to-can tamper evidencing arrangement 102 is shown in FIG. 10. A horizontal portion 104 of outer skirt 52 extends outwardly from the periphery of lower cover member 22 and contains a plurality of spaced apart weakened zones 106; a vertical portion 108 of outer skirt 52 extends downwardly from horizontal portion 104 and contains a plurality of spaced apart weakened zones 110. Weakened zones 106 and 110 comprise elongated notches which are substantially V-shaped in cross section. Weakened zones 106 are positioned horizontally in outer skirt 52 and weakened zones 110 are positioned vertically. In this embodiment, the surface of inner skirt 50 adjacent to can 12 preferably includes a small projection 112 for pressing can 12 against outer skirt 52. This embodiment is particularly adapted for use with straight edged cans.

Figure 11:
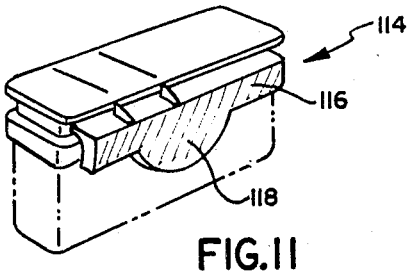
FIG. 11 is a front perspective view of an alternate version of the container cap of FIG. 1.

FIG. 11 illustrates an alternate embodiment of a lid-to-cap tamper evidencing means 114 which comprises a bar member 116 that extends downwardly over part of outer skirt 52 of lower cover member 22. Bar member 116 preferably includes a lift tab 118, to provide the user with a gripping surface when removing bar member 116.

Figure 12:
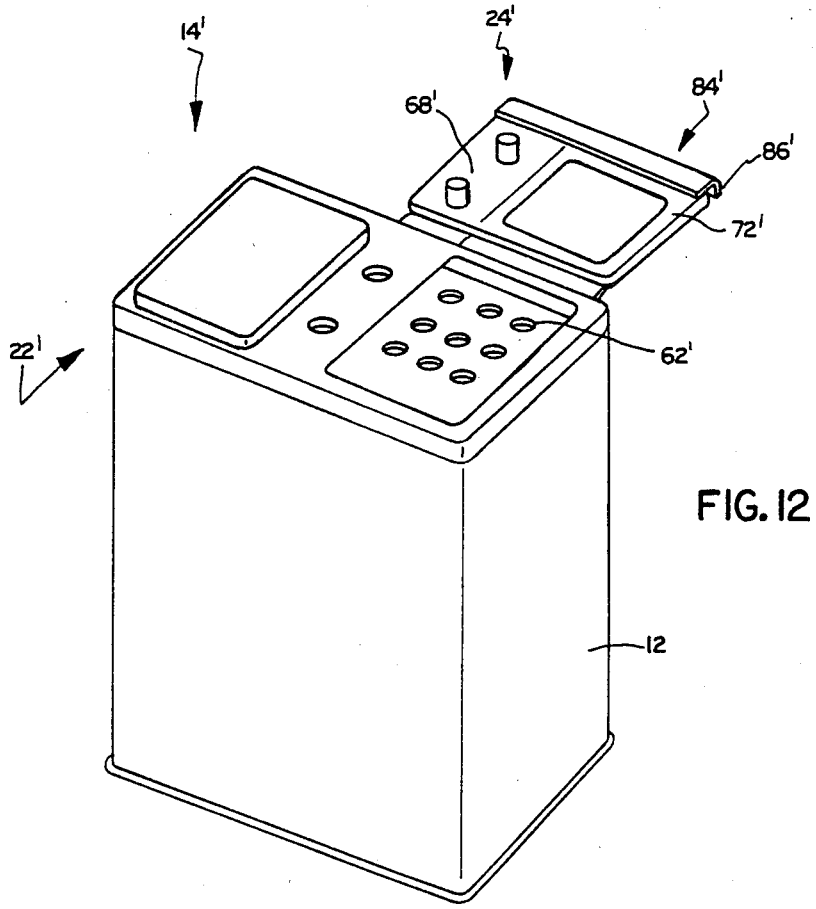
FIG. 12 is a front perspective view of another variation of the container cap of FIG. 1, mounted on a can and prior to final assembly.
Figure 13:
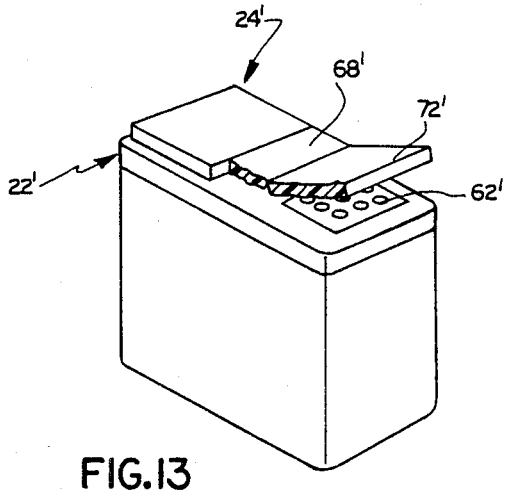
FIG. 13 is a front perspective view of the assembly of FIG. 12, assembled and with the container cap in the opened position.
Figure 14:
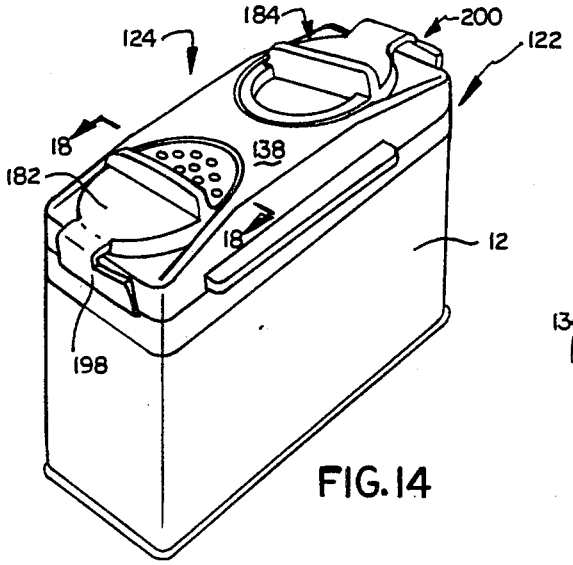
FIG. 14 is a front perspective view of a second embodiment of the tamper evidencing container cap of the present invention, assembled and mounted on a can.
Figure 15:
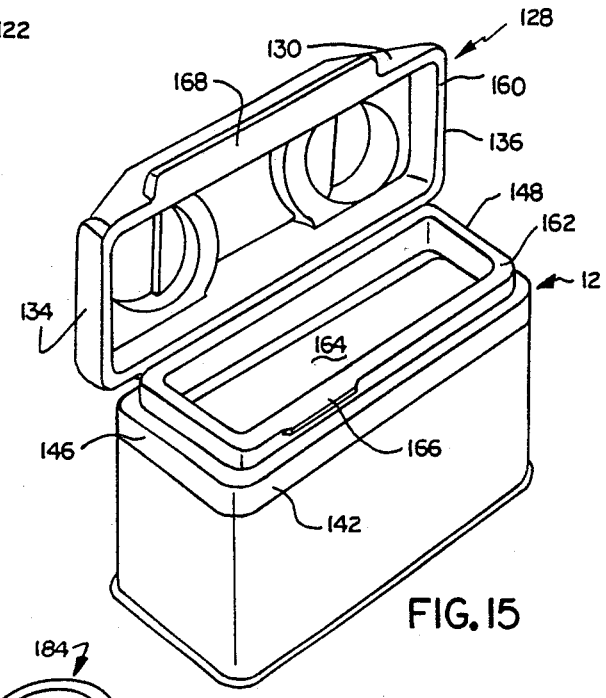
FIG. 15 is a front perspective view of the assembly of FIG. 14, with the container cap in the opened position.

Another alternate embodiment of the container cap of embodiment I is shown in FIGS. 12 and 13. Container cap 14' is identical to container cap 14 shown in FIG. 1, except that upper cover member 24' includes only one lid portion 72' and lower cover member 22' includes only one corresponding aperture 62' for removing the contents of can 12. Aperture 62' can be a plurality of sift holes, as illustrated, or can comprise a spoon hole (not shown) similar to the spoon hole 62 in the embodiment of FIG. 2. Tamper evidencing means 84' comprises an elongated bar member 86' integral with colinear sides of main body portion 68' of upper cover member 24' and lid 72'.

The lid-to-cap tamper evidencing means does not completely prevent surreptitious access to the contents of the can. Therefore, as an additional safety feature, the cap-to-can tamper evidencing means 90 or 102 may be employed to inhibit access to the contents of the can by removal of the entire cap.

Container cap 14 is preferably (but not necessarily) molded in one piece, as illustrated in FIG. 2. Preferably, the container cap of the present invention is made of a hard, resilient plastic, such as polypropylene; the can may be made of a metal, such as tin, or a plastic such as polypropylene. The particular type of polypropylene used depends on many factors, such as elasticity (needed for proper operation of living hinges), hardness (for strength), cost, etc.

Prior to mounting cap 14 on can 12, upper cover member 24 is closed over lower cover 22. Assembly pins 56 mate with assembly pin holes 58 to prevent further relative movement between cover members 22 and 24. Bar member 86 is generally inflexible along its longitudinal axis. It restrains lids 70 and 72 from pivoting about their hinged connections 74 and 76 and prevents the lids from being opened until bar member 86 is broken off. Thus, once cover members 22 and 24 are assembled and mounted to can 12, the contents of the can cannot be accessed via the sift or spoon openings until tamper evidencing means 84 is removed.

The cap 14 mounts to the can 12 as follows. In the embodiment of FIG. 9, the lower cover member 22 fits over the top of the can 12 in such a way that the bead or lip 20 lies between outer skirt 120 and inner skirt 94. Mounting is accomplished by pressing the cap downwardly onto the can; beveled face 96 of locking member 92 slides over lip or bead 20 until locking face 98 lies below the bottom edge of bead 20. The elastic restoring force inherent in the composition of the cap causes locking member 92 to return to the position shown in FIG. 9, thereby locking the cap against upward movment.

If excessive force is applied in an effort to remove the cap from the can, the weakened zones or webs 100 cause locking member 92 to separate in a ring from the rest of the cap and fall into the container. If the container is shaken, the consumer will hear the separated ring 92 rattling around inside the can and thus become aware of possible tampering. An advantage of the interior locking ring 92 is that it can be used with numerous types and sizes of cans without altering the outer structure of the cap or can. This is an important consideration with respect to packaging the cans in larger containers for shipping and for shelf stacking purposes. Because the outer configuration of the cap and can are not altered, it is not necessary to reconfigure the packaging; cans can be lined up in the same way as in the past.

In the embodiment shown in FIG. 10, the cap is also press fitted onto can 12. If someone tries to remove the cap from the can by force, the weakened zones formed in the outer skirt 52 will cause the outer skirt to tear away from the rest of the cap in whole or in part. Advantageously, a brightly colored line can be painted, drawn, lithoed, ect., around the upper rim of the can. This line would normally lie underneath the outer skirt 52 and become visible only when a portion or all of the outer skirt is torn away. There would thus be provided an immediate visual indication of tampering or attempted tampering with the container.

Preferred Embodiment II

FIGS. 14–18 illustrate a second preferred embodiment of a container in accordance with the present invention. The container, generally indicated by reference numeral 122, includes a can 12 and a one-piece molded container cap 124. Container cap 124 comprises a first, or lower cover member 126 (FIGS. 16, 18) and a second, or upper cover member 128 connected to cover member 126. Cover members 126 and 128 are substantially rectangular. Like the corresponding cover members of embodiment I, cover members 126 and 128 are preferably dimensioned to enable upper cover member 128 to fit inside the perimeter of the bead 18 of another similar container to permit containers to be stacked on top of each other.

Figure 18:
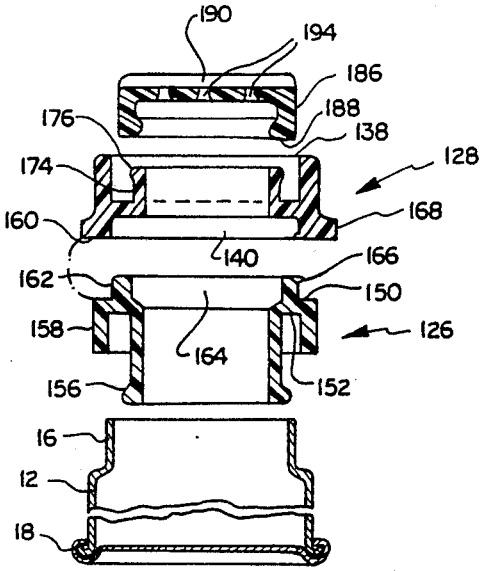
FIG. 18 is an exploded, cross-sectional view of the container cap, taken along line XVIII—XVIII of FIG. 14.
Figure 19:
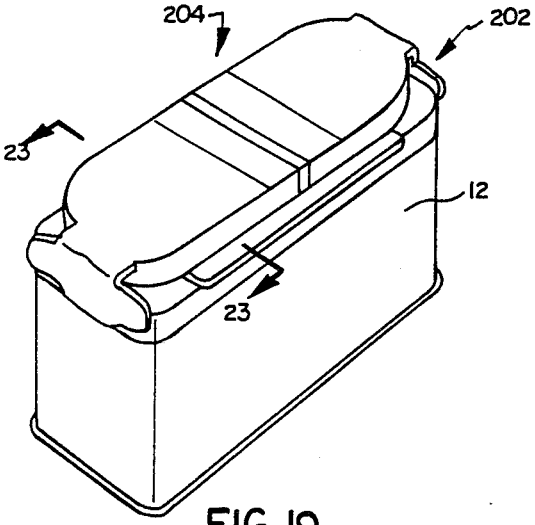
FIG. 19 is a front perspective view of a third embodiment of the tamper evidencing container cap of the present invention, assembled and mounted on a can.
Figure 20:
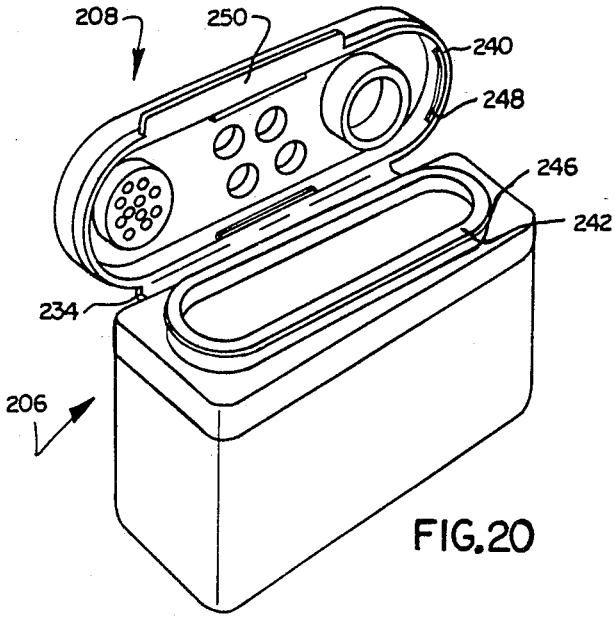
FIG. 20 is a front perspective view of the assembly of FIG. 19, with the container cap in a first opened position.
Figure 23:
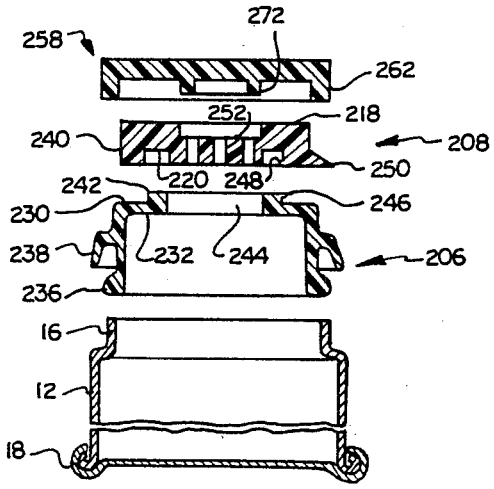
FIG. 23 is an exploded, cross-sectional view, taken along line XXIII—XXIII of the assembly of FIG. 19.
Figure 21:
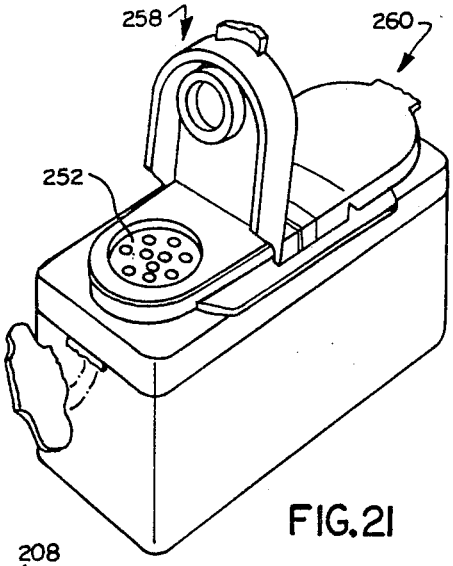
FIG. 21 is a front perspective view of the asembly of FIG. 19, with the container cap in a second opened position.

Upper cover member 128 has a front edge 130, a back edge 132, side edges 134 and 136, a top surface 138 (FIG. 14), and a bottom surface 140 (FIG. 18). Lower cover member 126 likewise has a front edge 142, a back edge 144, side edges 146 and 148, a top surface 150 (FIG. 18), and a bottom surface 152 (FIG. 18). A living hinge 154 (FIG. 16) connects lower and upper cover members 126 and 128 to each other at their respective back edges 144 and 132.

Similar to embodiment I, lower cover member 126 of embodiment II has an inner skirt 156 and an outer skirt 158 (FIG. 18) extending downwardly from its lower periphery. In the embodiment shown, the skirts 156, 158 engage reduced neck portion 16 of can 12. In an alternate configuration similar to that shown in FIG. 9, the inner and outer skirts engage the beaded top portion of a straight sided can.

Inner and outer skirts 156 and 158 preferably have the same configuration as inner and outer skirts 94 and 120 or 50 and 52 illustrated respectively in FIGS. 9 or 10 with respect to embodiment I of the invention. Skirts 156 and 158 preferably incorporate the further cap-to-can tamper evidencing means described with respect to embodiment I.

A sealing skirt 160 (FIGS. 15, 16) extends peripherally downwardly from bottom surface 140 of upper cover member 128. A ridge 162 extends upwardly from the top surface 150 of lower cover member 126 and surrounds a spoon hole 164 for spooning the contents from the interior of can 12. Ridge 162 has a lip 166 (FIGS. 15, 18) on its front edge for pressing against sealing skirt 160 to hold upper cover member 128 closed. A lip 168 (FIGS. 15, 18) extends outwardly from the lower edge of sealing skirt 160 to provide leverage for opening cover member 128 to the spoon position shown in FIG. 15.

Upper cover member 128 includes a pair of substantially similar recessed openings 170 and 172 (FIG. 16) for providing access to the contents of can 12. Each of openings 170 and 172 is surrounded by an upwardly extending circular flange 174 (FIG. 18); each flange has an outwardly extending lip 176 and an integral cover portion 178 (FIG. 17) having a semi-circular cut-out portion 180.

Container cap 124 further includes lids 182 and 184 (FIGS. 14, 16) which mount to upper cover member 128, in a manner to be described below, to permit them to rotate between open and closed positions. Each rotatable lid 182 and 184 has a peripheral, downwardly extending circular flange 186 (FIG. 18) for mating engagement with flange 174; a lip 188 extends inwardly from flange 186 and is adapted for a snap fit engagement with flange lip 176. Upwardly extending gripping members 190 and 192 (FIG. 16) are formed along respective diameters of lids 182 and 184. Members 190 and 192 may be gripped by the user to rotate the lids between open and closed positions. Each lid contains one or more apertures located to one side of the gripping member. For example, lid 182 may contain a plurality of sift holes 194 for sifting the contents of can 12, while lid 184 may have a semi-circular pour hole 196 for pouring the contents of can 12. Sift holes 194 and pour hole 196 are positioned so that they overlap the cover portions 178 (FIG. 17) when container cap 124 is initially assembled, to thereby seal the contents in container 122. Access to the contents of can 12 is obtained by rotating lid 182 or 184 so that sift holes 194 or pour hole 196 register with cut-out portions 180.

When container cap 124 is assembled, lids 182 and 184 are secured against rotation by tamper evidencing means 198 and 200 removably connected to lids 182 and 184 and to lower cover member 126. Preferably, tamper evidencing means 198 and 200 (FIGS. 14, 16) comprise tear tabs or strips integral with lower cover member 126 and rotatable lids 182 and 184, respectively, to prevent the lids from rotating (and opening) until the tamper evidencing means are removed.

Figure 16:
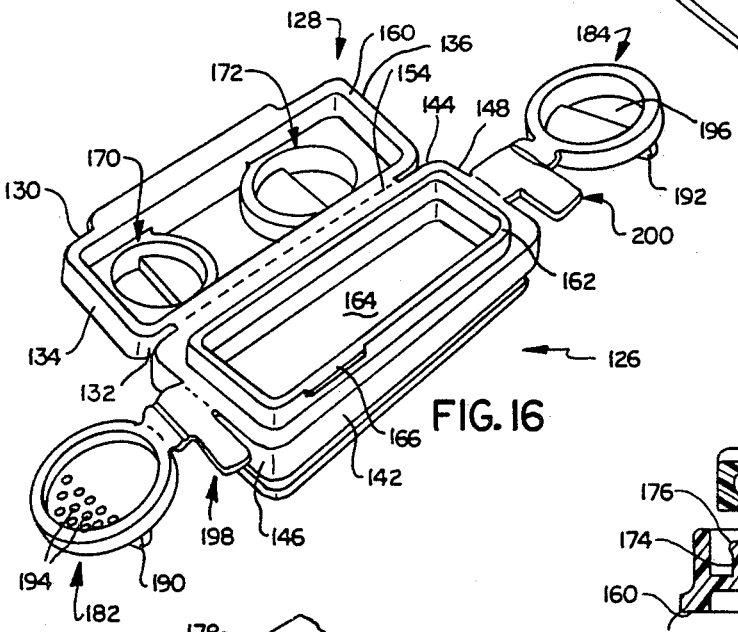
FIG. 16 is a top perspective view of the container cap of FIG. 14, prior to assembly.
Figure 17:
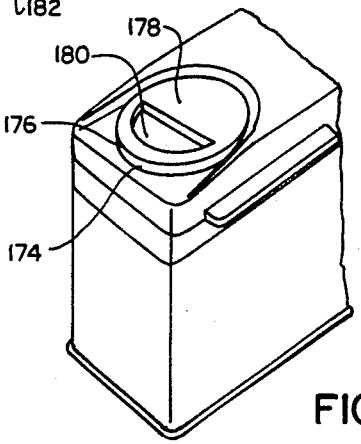
FIG. 17 is a perspective, fragmentary view of the container cap of FIG. 14, partially assembled and mounted on a can.

Container cap 124 is preferably molded in one piece, as illustrated in FIG. 16. When assembled, upper cover member 128 is closed over lower cover member 126. Lids 182 and 184 are then snap fitted over recessed openings 170 and 172, respectively. The mating engagement between lips 176 and 188 prevents lids 182 and 184 from being removed from upper cover member 128. The recessed nature of the fitting of lids 182 and 184 over openings 170 and 172, respectively, substantially prevents someone from inserting a prying tool between the underside of the lid and the cover member. Tamper evidencing means 198 and 200 prevent lids 182 and 184 from being rotated into the open position to permit access to the contents of container 122. Tamper evidencing means 198 and 200 also prevent upper cover member 128 from being pried open. Thus, once container cap 124 and can 12 are assembled, the contents of can 12 are inaccessable until tamper evidencing means 198 and 200 are removed.

Cap-to-can tamper evidencing means may be provided in lower cover member 126 in the same manner as in embodiment I of the invention.

Preferred Embodiment III

FIGS. 19–23 illustrate a third preferred embodiment of a tamper evidencing container in accordance with the present invention. The container, indicated generally by reference numeral 202, includes a can 12 and a one-piece molded container cap 204. Container cap 204 comprises a lower cover member 206 and an upper cover member 208 FIGS. 20, 22, 23 connected to cover member 206. Cover members 206 and 208 are substantially rectangular, but the corners of upper cover member 208 may be rounded, as illustrated in FIGS. 19–22.

Upper cover member 208 has a front edge 210 (FIG. 22), a back edge 212, side edges 214 and 216, a top surface 218 (FIG. 23), and a bottom surface 220. Lower cover member 206 likewise has a front edge 222 (FIG. 22), a back edge 224, side edges 226 and 228, a top surface 230 (FIG. 23), and a bottom surface 232. A living hinge 234 (FIG. 22) connects upper and lower cover members 208 and 206 to each other at their respective back edges 212 and 224.

Similar to embodiment I, lower cover member 206 has an inner skirt 236 and an outer skirt 238 (FIG. 23) extending downwardly from the periphery of lower cover member 206. In the embodiment shown, the skirts 236, 238 engage reduced neck portion 16 of can 12. In an alternate configuration similar to that shown in FIG.

9, the inner and outer skirts engage the beaded top portion of a straight sided can.

Inner and outer skirts 236 and 238 preferably have the same configuration as inner and outer skirts 94 and 120 or 50 and 52 illustrated respectively in FIGS. 9 or 10 with respect to embodiment I of the invention, and also preferably incorporate the cap-to-can tamper evidencing means described with respect to that embodiment.

A sealing skirt 240 (FIG. 20, 23) extends peripherally downwardly from bottom surface 220 of upper cover member 208. A ridge 242 extends upwardly from the top surface 230 of lower cover member 206 and surrounds a spoon hole 244 (FIGS. 22, 23) for spooning the contents from can 12. Ridge 242 has a lip 246 (FIGS. 22, 23) on its front edge for engaging a corresponding lip 248 (FIGS. 20, 23) on the inside face of sealing skirt 240 to hold upper cover member 208 closed. A lip 250 FIGS. 20, 23 extends outwardly from the lower edge of sealing skirt 240 to provide leverage for opening cover member 208 to the spoon position shown in FIG. 20.

Upper cover member 208 includes a circular recess 252 (FIGS. 21, 23) at one end with a plurality of sift holes 254 (FIG. 22) located therein for sifting the contents of can 12. A pour hole 256 (FIGS. 22) is located at the other end of cover member 208 for pouring the contents of the can.

A pair of lids 258 and 260 (FIGS. 21, 22) mounts to upper cover member 208, in a manner described in more detail below, for movement between open and closed positions to cover sift holes 254 and pour hole 256, respectively, in cover member 208. Lids 258 and 260 are dimensioned to fit over upper cover member 208, but inside the perimeter of the bead 18 (FIG. 23) of another similar container, to permit containers to be stacked on top of each other.

Each of lids 258 and 260 includes a rim 262 (FIGS. 22, 23) extending downwardly from its periphery for sealing engagement with one end of upper cover member 208. Each lid also has an anchoring body portion 264 (FIG. 22) coupled to the lid by a living hinge 266. Each anchoring body portion 264 has a pair of one-way assembly pins 268 extending from the underside and adapted for non-removable mating engagement with a pair of assembly pin holes 270 in upper cover member 208. Hinged lids 258 and 260 can also have a circular seal rim 272 for sealing engagement with circular recess 252 and pour hole 256, respectively.

When container cap 204 is assembled, lids 258 and 260 are secured by tamper evidencing means 274 and 276 (FIG. 22) removably connected between the lids and lower cover member 206. Preferably, tamper evidencing means 274 and 276 comprise tear tabs or strips integral with lower cover member 206 and lids 258 and 260, respectively, to prevent the lids from opening until the tamper evidencing means are removed.

Figure 22:
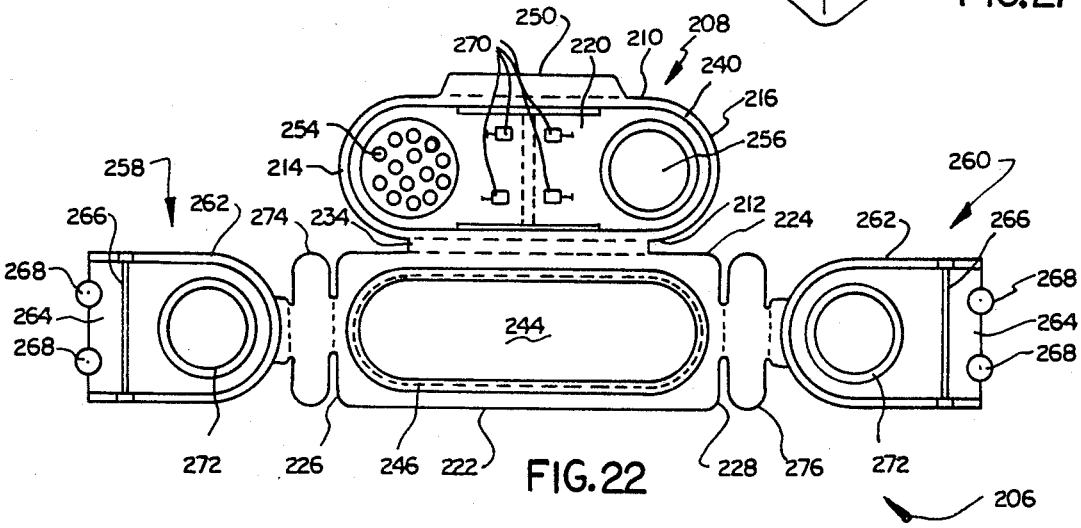
FIG. 22 is a top plan view of the container cap of FIG. 19, prior to assembly.
Figure 24:
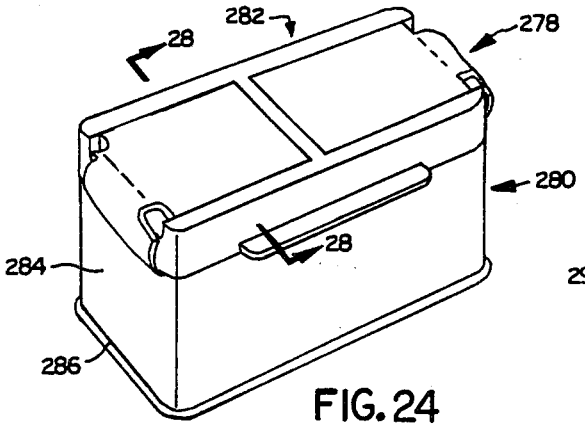
FIG. 24 is a front perspective view of a fourth preferred embodiment of the tamper evidencing container cap of the present invention, integrally formed with and assembled on a can.
Figure 25:
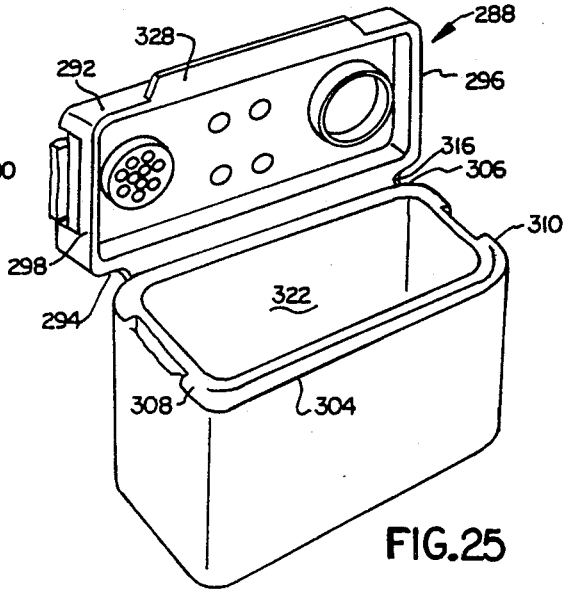
FIG. 25 is a front perspective view of the assembly of FIG. 24 in a first opened position.
Figure 26:
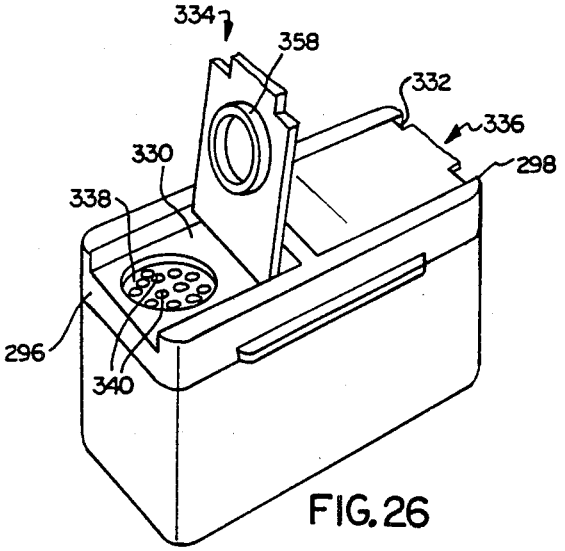
FIG. 26 is a front perspective view of the assembly of FIG. 24 in a second opened position.
Figure 28:
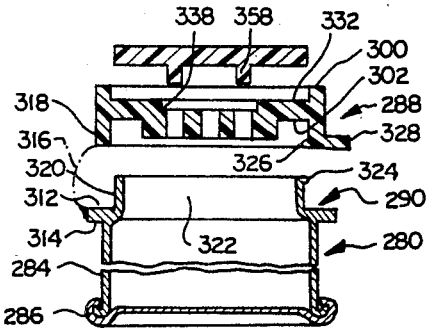
FIG. 28 is an exploded, cross-sectional view, taken along the line XXVIII—XXVIII, of the assembly of FIG. 24.

Container cap 204 is preferably molded in one piece, as illustrated in FIG. 22. When assembled, upper cover member 208 is closed over lower cover member 206. Lids 258 and 260 are folded over onto cover member 208 and then non-removably mounted to cover member 208 by snapping assembly pins 268 into their mating assembly pin holes 270. Tamper evidencing means 274 and 276 prevent lids 258 and 260, respectively, and upper cover member 208 from being opened. Thus, once container cap 204 and can 12 are assembled, the contents of can 12 are inaccessible until tamper evidencing means 274 and 276 are removed.

Preferred Embodiment IV

Figure 27:
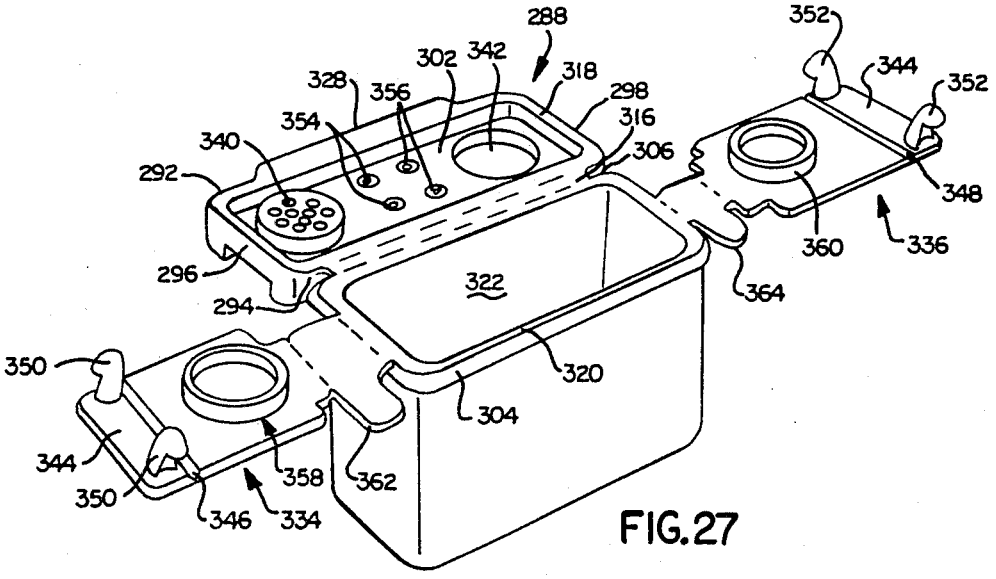
FIG. 27 is a front perspective view of the container cap and can of FIG. 24, unassembled.
Figure 29:
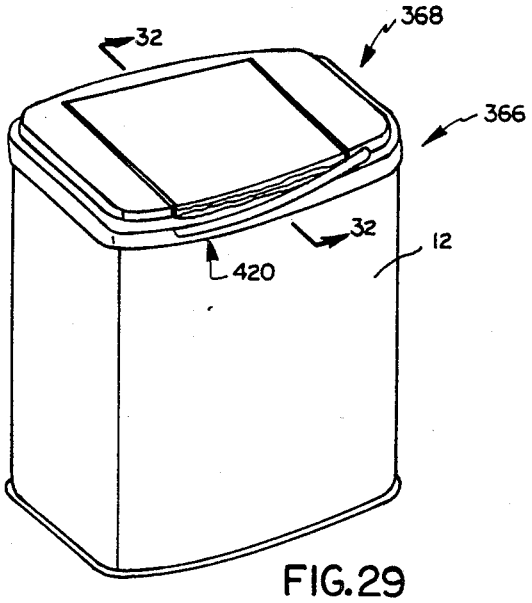
FIG. 29 is a front perspective view of a fifth preferred embodiment of the container cap of the present invention, assembled and mounted on a can.

FIGS. 24–28 illustrate a fourth preferred embodiment of a tamper evidencing container in accordance with the present invention. The container, indicated generally by reference numeral 278, includes a can 280 and a one-piece molded container cap 282. Can 280 has a body 284 and a lip or bead 286 extending downwardly from the periphery of the bottom of body 284. Can 280 and cap 282 may be separate elements, in the same fashion as described above with respect to the preceding embodiments; alternatively, can 280 and cap 282 may be of one piece molded contruction as shown in FIG. 27.

Container cap 282 comprises a cover member 288, which may be connected to or integral with the upper edge 290 (FIG. 28) of body 284 of can 280. Alternatively, container cap 282 may be molded separately from can 280. In that case, cover member 288 would be formed as part of a larger unit including a second, lower cover member mountable to the upper edge of can body 284 in a similar manner to the mounting of lower cover member 206 to can 12 in embodiment III shown in FIGS. 19–22.

Cover member 288 is substantially rectangular in conformance with the shape of can 280. Cover member 288 preferably is dimensioned to fit inside the perimeter of the bead of another similar container, to permit containers to be stacked on top of each other.

Cover member 288 has a front edge 292 (FIGS. 25,27), a back edge 294, side edges 296 and 298, a top surface 300 (FIG. 28), and a bottom surface 302. Upper edge 290 (FIG. 28) of can body 284 likewise has a front edge 304 (FIG. 27), a back edge 306 (FIG. 25), side edges 308 and 310, a top surface 312 (FIG. 28), and a bottom surface 314. Cover member 288 is advantageously connected to upper can body edge 290 at their back edges 294 and 306 by a living hinge 316.

A sealing skirt 318 (FIG. 28) extends downwardly from the periphery of the bottom surface 302 of cover member 288. A ridge 320 extends upwardly from the periphery of top surface 312 of can body edge 290 and surrounds a spoon hole 322 for spooning the contents from can 280. Ridge 320 has a lip 324 (FIG. 28) on its front edge for engaging a corresponding lip 326 on the inside face of sealing skirt 318 to hold cover member 322 closed. A lip 328 extends outwardly from the lower edge of sealing skirt 318 to provide leverage for opening cover member 288 to the spoon position shown in FIG. 25.

Cover member 288 includes a pair of rectangular recesses 330 and 332 (FIG. 26) extending from side edges 296 and 298, respectively, towards the center of cover member 288 for receiving a pair of lids 334 and 336, respectively. One such rectangular recess, e.g., recess 330, contains a circular recess 338 having a plurality of sift holes 340 located therein. A pour hole 342 (FIG. 27) is contained in the other rectangular recess, e.g., recess 332.

Lids 334 and 336 are mounted to cover member 288, in a manner described in more detail below, for movement between open and closed positions to cover sift holes 340 and pour hole 342, respectively, in cover member 288. Lids 334 and 336 are substantially rectangular or square. Each of lids 334 and 336 has an anchoring body portion 344 (FIG. 27) coupled to the main lid portion by respective living hinges 346 and 348. Each anchoring body portion 344 has a pair of one-way assembly pins 350 and 352 extending downwardly from the underside. Assembly pins 350 and 352 are adapted for non-removable mating engagement with a pair of assembly pin holes 354 and 356 in rectangular recesses 330 and 332, respectively. Living hinges 346 and 348 connecting lids 334 and 336 to anchoring body portions 344 enable the lids to open and close. Assembly pins 350 and 352 are positioned so that lids 334 and 336 open towards side edges 296 and 298, respectively, of upper cover member 288. Lids 334 and 336 may incorporate circular seal rims 358 and 360 which engage the perimeters of circular recess 338 and pour hole 342, respectively, to provide an effective seal for these openings.

When container cap 282 is assembled, lids 334 and 336 are secured by tamper evidencing means 362 and 364 removably connected between the lids and can body upper edge 290. Preferably, tamper evidencing means 362 and 364 comprise tear tabs or strips integral with and intermediate lower cover member 290 and hinged lids 334 and 336, respectively, to prevent the lids from opening until the tamper evidencing means are removed.

Container cap 282 and can 280 preferably are molded in one piece, as illustrated in FIG. 27. Cap 282 is assembled after can 280 is filled. Cap 282 is assembled by closing cover member 288 over can body upper edge 290. Lids 334 and 336 are folded over onto cover member 288 and then non-removably mounted to cover member 288 by snapping assembly pins 350 and 352 into their mating assembly pin holes 354 and 356. Tamper evidencing means 362 and 364 prevent lids 334 and 336, respectively, and cover member 288 from being opened until the tamper evidencing means are removed.

If container cap 282 is formed separately from can 280, in a similar manner to previously described embodiments, further tamper evidencing means can be provided in the cap portion that mounts to the can. Such further tamper evidencing means would be similar in configuration and operation to the cap-to-can tamper evidencing means 90 or 102 provided in embodiment I of the invention.

PREFERRED EMBODIMENT V

FIGS. 29–34 illustrate a fifth preferred embodiment of a container in accordance with the present invention. The container, indicated generally by the reference numeral 366, includes a can 12 and a one-piece molded container cap 368. Container cap 368 comprises a first, or lower cover member 370 (FIGS. 31, 32), and a second, or upper cover member 372 connected to cover member 370.

Cover members 370 and 372 are substantially rectangular. Upper cover member 372 may be somewhat shorter in length and width than lower cover member 370, and is preferably dimensioned to fit inside the perimeter of the bead of another similar container to permit containers to be stacked on top of each other.

Upper cover member 372 has a front edge 374 (FIG. 31), a back edge 376, side edges 378 and 380, a top surface 382 (FIG. 32), and a bottom surface 384. Lower cover member 370 likewise has a front edge 386 (FIG. 31), a back edge 388, side edges 390 and 392, a top surface 394 (FIG. 32), and a bottom surface 396.

Similar to embodiment I, lower cover member 370 of embodiment V has an inner skirt 398 and an outer skirt 400 extending downwardly from its lower periphery to engage the neck or top beaded edge of can 12. Cover members 370 and 372 are preferably connected to each other by a hinge 402 FIG. 31 between their respective side edges 392 and 378.

Figure 30:
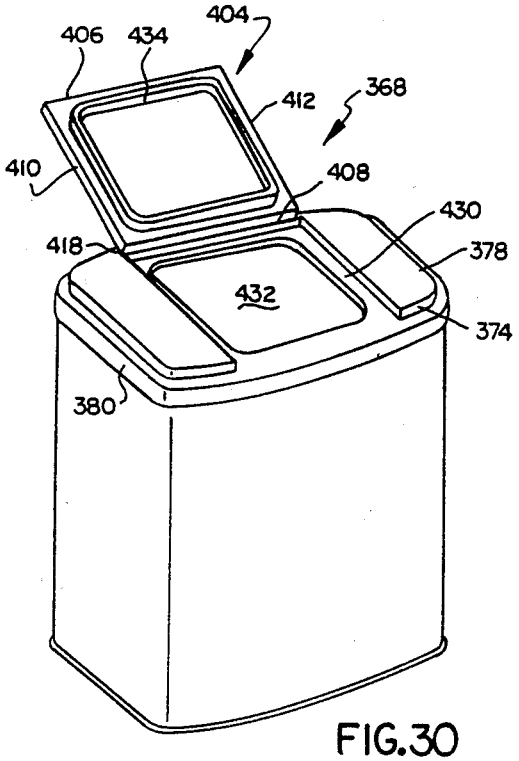
FIG. 30 is a front perspective view of the container cap shown in FIG. 29, with the container cap in the opened position.
Figure 32:
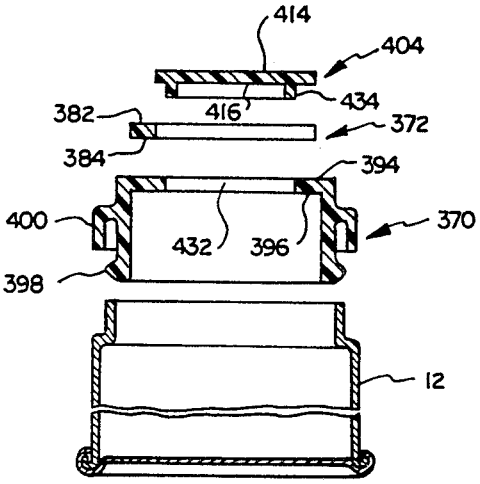
FIG. 32 is an exploded, cross-sectional view, taken along line XXXII—XXXII, of the assembly of FIG. 29.

A lid 404 (FIGS. 30, 32) is mounted to upper cover member 372. Lid 404 is substantially rectangular or square. Lid 404 has a front edge 406, a back edge 408, side edges 410 and 412, a top surface 414, and a bottom surface 416. Lid 404 and upper cover member 372 are connected to each other between back edge 408 of lid 404 and top surface 382 of upper cover member 372 adjacent its back edge 376 by a living hinge 418 (FIG. 30). A tamper evidencing means 420 (FIG. 31) is integral with hinged lid 404 and upper cover member 372 and is removably connected thereto to prevent lid 404 from opening until the tamper evidencing means is removed.

Upper cover member 372 is securely mounted to lower cover member 370 by mounting means comprising two pairs of one-way assembly pins 422 and 424. Assembly pins 422 and 424 extend downwardly from bottom surface 384 of upper cover member 372 adjacent side edges 378 and 380, respectively, for non-removable mating engagement with two pairs of assembly pin holes 428 and 426, respectively, in lower cover member 370. These mounting means substantially prevent relative movement between cover members 370 and 372 once container cap 368 is assembled.

Upper cover member 372 has an aperture 430 (FIG. 30) for receiving lid 404. A spoon hole 432 is located in lower cover member 370 below aperture 430 for spooning the contents of can 12. Lid 404 may incorporate a sealing rim 434 extending downwardly from its bottom surface 416 for sealing engagement with the perimeter of spoon hole 432.

Lid receiving aperture 430 extends to front edge 374 of upper cover member 372. When lid 404 is in the closed position, its front edge 406 is substantially colinear with the front edge 374 of upper cover member 372. Tamper evidencing means 420 (FIG. 29) is integral with the front edge 406 of lid 404 and with at least part of front edge 374 of upper cover member 372 where it adjoins front edge 406 of lid 404. Tamper evidencing means 420 preferably comprises an elongated bar member 436. Bar member 436 preferably is L-shaped in cross-section, extending outwardly from front edges 406 and 374 of lid 404 and upper cover member 372, respectively, and upwardly substantially even with top surface 382 of upper cover member 372.

The combined widths of bar member 436, upper cover member 372 and lid 404 preferably do not exceed the width of lower cover member 370. Thus, when cover members 370 and 372 and lid 404 are closed, bar member 436 does not extend beyond the corresponding edge of lower cover member 370.

Figure 31:
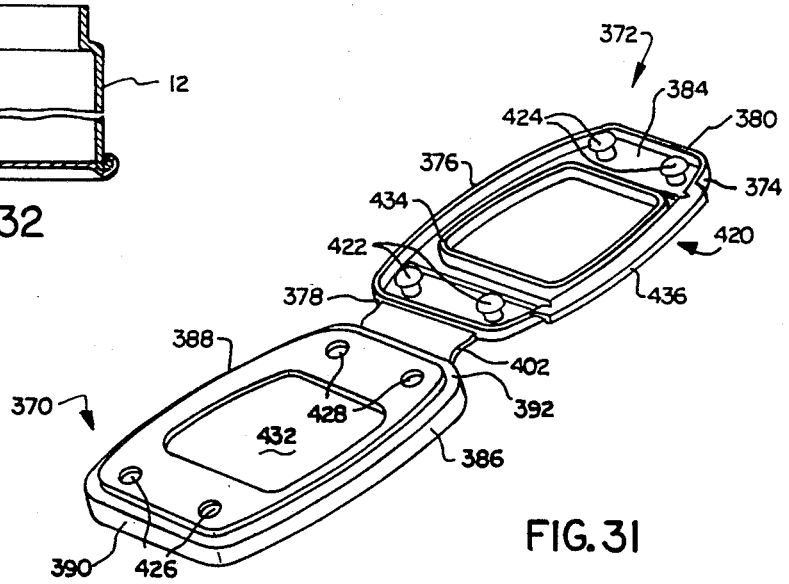
FIG. 31 is a top perspective view of the container cap of FIG. 30, prior to assembly.

Container cap 368 is preferably molded in one piece, as shown in FIG. 31. Before assembly with can 12, upper cover member 372 is closed over lower cover member 370 so that one-way assembly pins 422 and 424 non-removably engage assembly pin holes 428 and 426. The mating of assembly pins 422 and 424 with assembly pin holes 428 and 426 substantially prevents relative movement between upper cover member 372 and lower cover member 370. Lid 404 thus cannot be opened until tamper evidencing means 420 is removed. Once container cap 368 and can 12 are assembled, access to the contents of container 366 is only obtainable by removing tamper evidencing means 420 and opening lid 404 on its hinge.

Further cap-to-can tamper evidencing means may be provided in lower cover memoer 370 in the same manner as in, inter alia, embodiment I of this invention.

Figure 33:
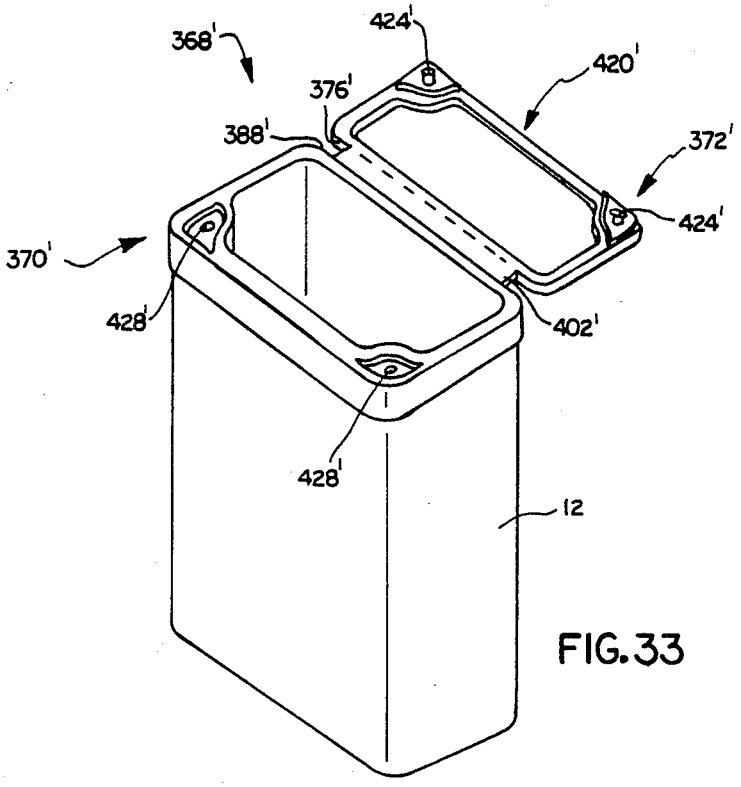
FIG. 33 is a front perspective view of an alternate embodiment of the container cap of FIG. 29, mounted on a can prior to assembly.
Figure 34:
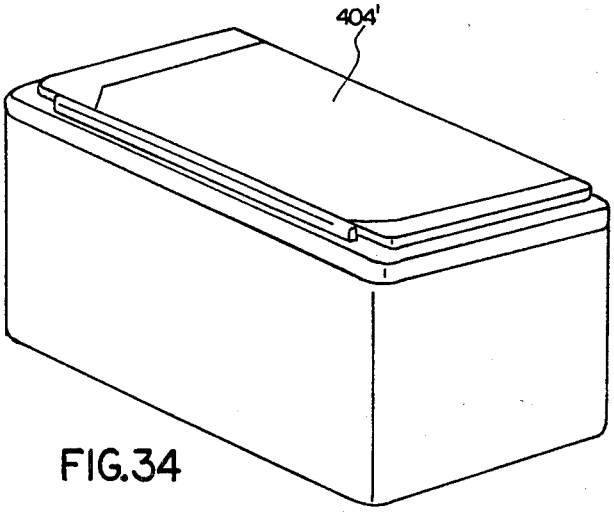
FIG. 34 is a front perspective view of the assembly of FIG. 33, assembled and with the container cap in the closed position.

An alternate embodiment of the container cap of embodiment V is shown in FIGS. 33 and 34. Container cap 368' is similar to container cap 368 shown in FIG. 29, except for the location of the hinge connecting upper and lower cover members 372' and 370' and the means for mounting upper cover member 372' to lower cover member 370'. Hinge 402' connecting upper and lower cover members 372' and 370' is positioned between their respective back edges 376' and 388'. Upper cover member 372' is mounted to lower cover member 370' by mounting means comprising a single pair of one-way assembly pins 424' extending from upper cover member 372' for non-removable mating engagement with a pair of assembly pin holes 428'. Also, lid 404' may be a shape which is other than rectangular or square; e.g., it may be hexagonal as illustrated.

PREFERRED EMBODIMENT VI

FIGS. 35–42 illustrate a sixth preferred embodiment of a container in accordance with the present invention. The container, indicated generally by reference numeral 438, includes a can 12 and a one-piece molded container cap 440.

Container cap 440 comprises a first, or lower cover member 442 (FIG. 37) and a second, or upper cover member 444 connected to lower cover member 442 and adapted to be slideably mounted thereon.

Upper and lower cover members 444 and 442 are substantially rectangular, and are substantially the same width and length. They are preferably dimensioned to enable upper cover member 444 to fit inside the perimeter of the bead of another similar container, to permit containers to be stacked on top of each other.

Upper cover member 444 has a front edge 446, a back edge 448, side edges 450 and 452, a top surface 454 (FIG. 38), and a bottom surface 456. Lower cover member 442 likewise has a front edge 458 (FIG. 37), a back edge 460, side edges 462 and 464, a top surface 466 (FIG. 38), and a bottom surface 468.

Similar to embodiment I, lower cover member 442 of this embodiment also has an inner skirt 470 (FIG. 38) and an outer skirt 472 extending downwardly from the periphery of lower cover member 442 to engage the neck or top beaded edge of can 12. Tamper evidencing means 474 (FIGS. 36, 37) is removably connected to upper and lower cover members 444 and 442 to prevent upper cover member 444 from opening until the tamper evidencing means is removed. Preferably, tamper evidencing means 474 comprises a tear strip integral with and intermediate upper and lower cover members 444 and 442 so as to hingedly connect them.

Figure 37:
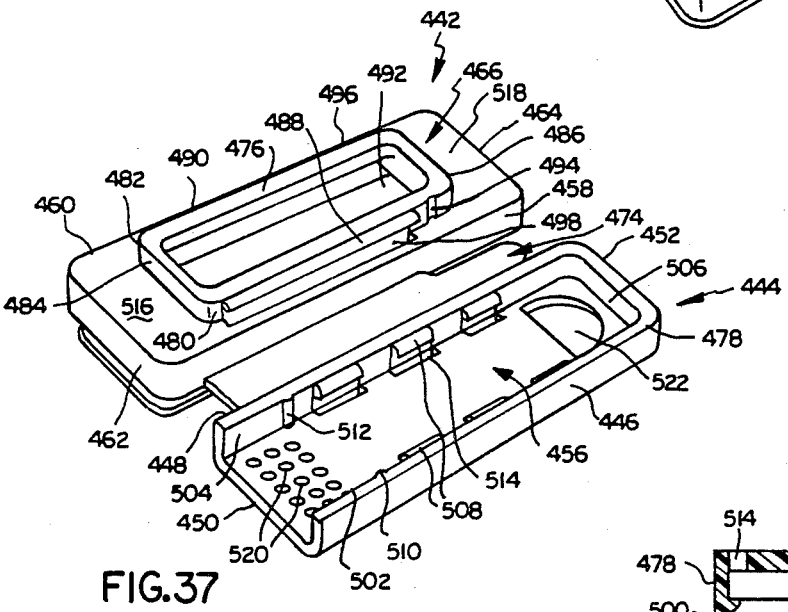
FIG. 37 is a top perspective view of the container cap of FIG. 35, prior to assembly.
Figure 38:
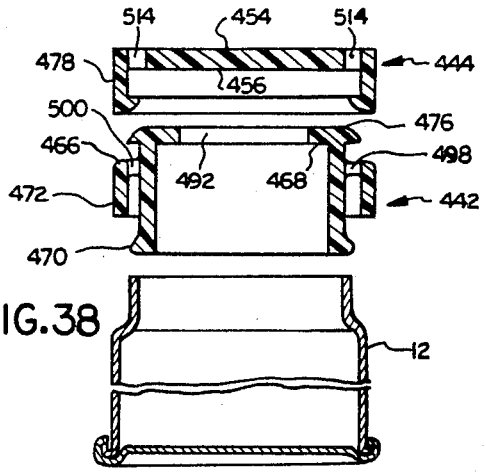
FIG. 38 is an exploded, cross-sectional view, taken along line XXXVIII—XXXVIII; of the assembly of FIG. 35.

Upper cover member 444 is mounted to lower cover member 442 by mounting means comprising a rectangular ribbed flange 476 FIGS. 37, 38 extending upwardly from top surface 466 of lower cover member 442 and a mating ribbed lower skirt 478 extending downwardly from the bottom surface 456 of upper cover member 444. Ribbed flange 476 comprises an outer front wall 480 (FIG. 37), an outer back wall 482, outer side walls 484 and 486, a pair of elongated one-way ribs 488 and 490 extending outwardly from the top of outer front and back walls 480 and 482, and a central spoon hole 492 for spooning the contents from can 12. Ribs 488 and 490 include a pair of notches 494 and 496 adjacent side wall 486, for a purpose to be described hereinafter.

Lower cover member 442 includes a pair of elongated mold cavities 498 and 500 at the base of front and back walls 480 and 482 corresponding to ribs 488 and 490.

Ribbed lower skirt 478 extends from the periphery of upper cover member 444 on three edges only. Skirt 478 is open at side edge 450. Lower skirt 478 comprises an inner front wall 502, an inner back wall 504, inner side wall 506, and a plurality of spaced apart one-way ribs 508 extending inwardly from the bottom of inner front and back walls 502 and 504, for sliding engagement with one-way ribs 488 and 490. Inner front wall 502 and inner back wall 504 include a pair of vertical protusions 510 and 512 extending inwardly therefrom, for engagement with notches 496 and 494, respectively. Upper cover member 444 includes a plurality of spaced apart mold cavities 514 adjacent front and back edges 446 and 448 corresponding to ribs 508.

Ribbed flange 476 is dimensioned to provide a pair of margins 516 and 518 adjacent side edges 462 and 464 of lower cover member 442. Upper cover member 444 includes a plurality of sift holes 520 adjacent side edge 450 and a pour hole 522 adjacent side edge 452, so that when upper cover member 444 is in the closed position, sift holes 520 and pour hole 522 overlap margins 516 and 518, respectively, making the contents of container 438 inaccessible from the outside. Pour hole 522 preferably is located adjacent the closed end of skirt 478 and sift holes 520 at the open end thereof, because the closed end of skirt 478 provides greater support for pour hole 522.

Lower cover member 442 may also comprise cap-to-can tamper evidencing means incorporated in outer skirt 472, similar to tamper evidencing means 90 or 102 provided in embodiment I of the invention.

Figure 36:
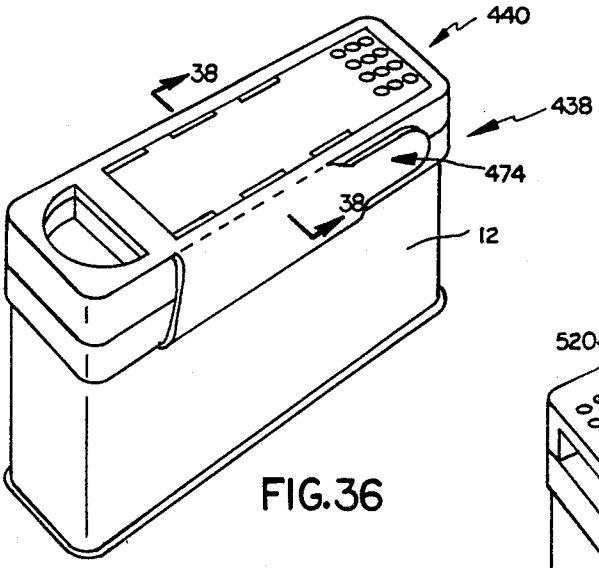
FIG. 36 is a rear perspective view of the container cap of FIG. 35.
Figure 35:
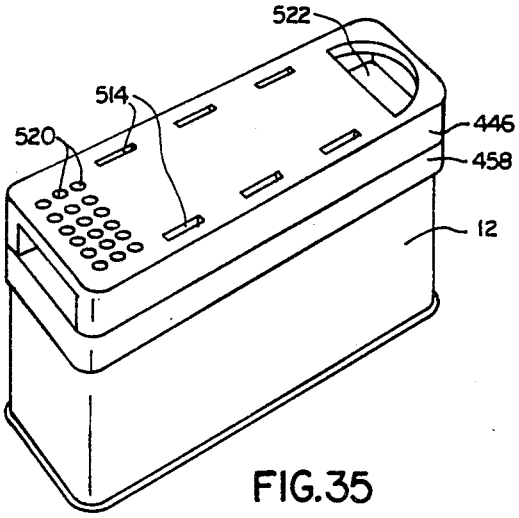
FIG. 35 is a front perspective view of a sixth preferred embodiment of the tamper evidencing container cap of the present invention, assembled and mounted on a can.
Figure 39:
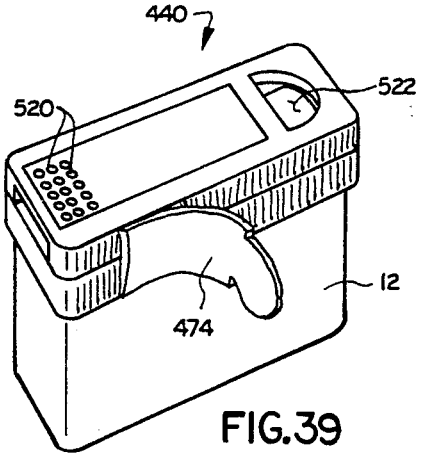
FIG. 39 is a front perspective view of the assembly of FIG. 35, with the tamper evidencing mechanism partially removed.

Container cap 440 is preferably molded in one piece, as illustrated in FIG. 37. Ribs 508 in upper cover member 444 are snap fitted over ribs 488 and 490 in lower cover member 442. Because of the one-way configuration of ribs 488, 490, and 508, they cannot be disengaged from each other. Access to the contents of can 12 is gained through sliding upper cover member 442 from side to side across lower cover member 442, as shown in FIGS. 36–38. However, upper cover member 444 cannot be opened until tamper evidencing means 474 is removed, as shown in FIG. 39.

Figure 40:
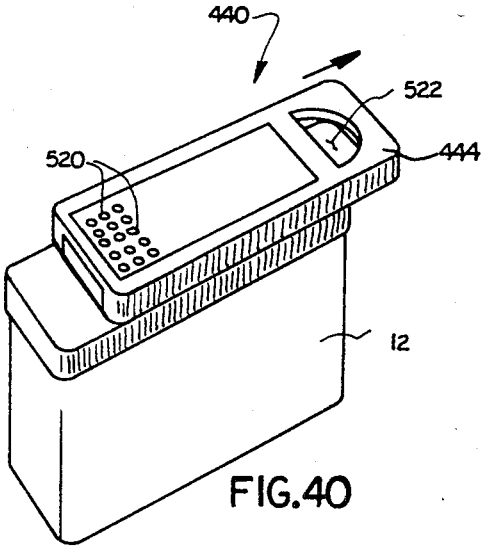
FIG. 40 is a front perspective view of the assembly of FIG. 35 in a first opened position.
Figure 41:
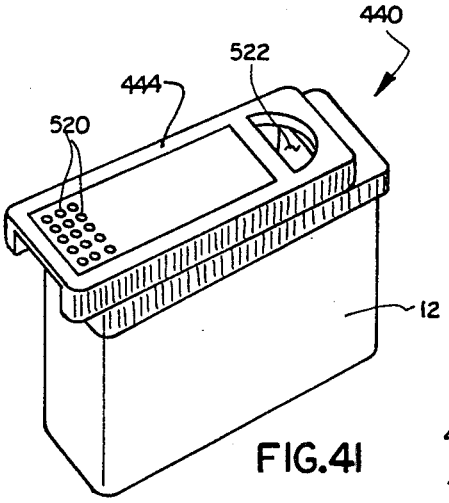
FIG. 41 is a front perspective view of the assembly of FIG. 35 in a second opened position.
Figure 42:
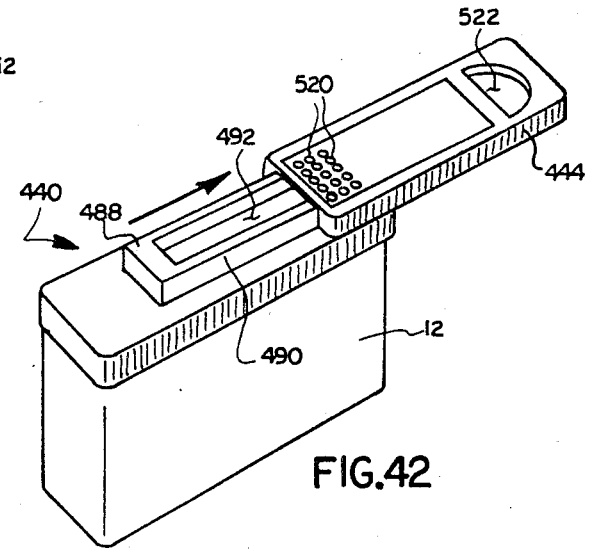
FIG. 42 is a front perspective view of the assembly of FIG. 35 in a third opened position.

In order to remove the contents of the can by sifting, upper cover member 444 is slid sideways until sift holes 520 overlap spoon hole 492, as shown in FIG. 40. The presence of protusions 510 and 512 in upper cover member 444 make it necessary to exert some force to cause protusions 510 and 512 to pass over the ends of ribs 488 and 490, respectively. As upper cover member 444 slides over lower cover member 442, protusions 510 and 512 force ribs 488 and 490 downwardly and inwardly. In order to remove the contents of the can by spooning, upper cover member 444 is slid further to the side until spoon hole 492 is fully uncovered, as shown in FIG. 42. Upper cover member 444 is prevented from sliding off of lower cover member 442 by notches 494 and 496, which engage protusions 512 and 510. Upper cover member 444 can be removed completely by exerting enough force to cause protusions 512 and 510 to pass over the ends of ribs 488 and 490 adjacent side wall 486. In order to remove the contents of the can by pouring, upper cover member 444 is slid in the opposite direction until pour hole 522 overlaps spoon hole 492, as shown in FIG. 41.

Obviously, numerous modifications and variations of the present invention are possible in light of the above teachings. For example, the configurations of the sift, pour, and spoon holes can be varied, and different combinations of lid configurations and tamper evidencing means can be used in a single container cap. Also, the container cap can be manufactured either separately from or integrally with the can. It is therefore to be understood that within the scope of the appended claims, the invention may be practiced otherwise than as specifically described herein.

What is claimed is:

1. A tamper evidencing container cap, comprising:

first and second cover members connected to each other;

mounting means for securely mounting said second cover member to said first cover member to substantially prevent relative movement therebetween;

first and second lids hinged to said second cover member; and tamper evidencing means removably connected to said first and second lids to prevent said lids from opening until said tamper evidencing means is removed.

2. A tamper evidencing container cap as claimed in claim 1, wherein said lids are hinged for pivoting movement about substantially parallel pivot axes; and said tamper evidencing means is integral with colinear edges of said lids along an axis substantially perpendicular to said parallel pivot axes.

3. A tamper evidencing container cap as claimed in claim 2, wherein said tamper evidencing means comprises an elongated bar member having at least one weakened zone along its length.

4. A tamper evidencing container cap as claimed in claim 3, wherein said bar member is L-shaped in cross-section.

5. A tamper evidencing container cap as claimed in claim 4, wherein the combined widths of said second cover member and said tamper evidencing means do not exceed the width of said first cover member, such that when said first and second cover members are closed, said bar member does not extend beyond the corresponding edge of said first cover member.

6. A tamper evidencing container cap as claimed in claim 1, comprising further tamper evidencing means incorporated in said first cover member.

7. A tamper evidencing container cap as claimed in claim 6, wherein said further tamper evidencing means comprises a skirt extending from the periphery of said first cover member for engaging a side surface of the container, said skirt having a plurality of spaced apart weakened zones around its periphery.

8. A tamper evidencing container cap as claimed in claim 7, wherein said skirt comprises a horizontal portion extending outwardly from the periphery of said first cover member and a vertical portion extending downwardly from the periphery of said horizontal portion;

said weakened zones being incorporated in said horizontal portion of said skirt, in said vertical portion of said skirt, or in both said horizontal and vertical portions of said skirt.

9. A tamper evidencing container cap as claimed in claim 8, wherein said weakened zones comprise elongated notches, said notches being substantially V-shaped in cross-section.

10. A tamper evidencing container cap as claimed in claim 9, wherein said weakened zones are disposed horizontally in said horizontal portion of said skirt and vertically in said vertical portion of said skirt.

11. A tamper evidencing container cap, comprising:

first and second cover members, said second cover member incorporating at least one lid selectively movable between open and closed positions to selectively permit access to the contents of the container;

mounting means for securely mounting said first and second cover members to each other; and tamper evidencing means comprising a skirt extending from the periphery of said first cover member for engaging a side surface of the container, said skirt having a plurality of spaced apart weakened zones around its periphery.

12. A tamper evidencing container cap as claimed in claim 11 wherein said skirt comprises a horizontal portion extending outwardly from the periphery of said first cover member and a vertical portion extending downwardly from the periphery of said horizontal portion;

said weakened zones being incorporated in said horizontal portion of said skirt, in said vertical portion of said skirt, or in both said horizontal and vertical portions of said skirt.

13. A tamper evidencing container cap as claimed in claim 12, wherein said weakened zones comprise elongated notches, said notches being substantially V-shaped in cross-section.

14. A tamper evidencing container cap as claimed in claim 13, wherein said weakened zones are disposed horizontally in said horizontal portion of said skirt and vertically in said vertical portion of said skirt.

15. A tamper evidencing container cap, comprising:

first and second cover members connected to each other for covering a container and selectively providing access to the contents thereof;

first and second lids mounted to said second cover member for movement relative to said second cover member between open and closed positions, wherein in said open position the contents of the container are accessible from the outside and in said closed position the contents of the container are inaccessible from the outside; and tamper evidencing means removably connected to said first and second lids, to prevent said lids from opening until said respective tamper evidencing means is removed.

16. A tamper evidencing container cap as claimed in claim 15, wherein said tamper evidencing means comprises first and second tab members, each having at least one weakened zone along its length;

said first tab member being integral with said first lid and said first cover member, and said second tab member being integral with said second lid and said first cover member.

17. A tamper evidencing container cap, comprising:

first and second cover members connected to each other;

mounting means for securely mounting said second cover member to said first cover member to substantially prevent relative movement therebetween;

lid means hinged to said second cover member; and tamper evidencing means removably connected to and between said lid means and one of said cover members to prevent said lid means from opening until said tamper evidencing means is removed.

18. A tamper evidencing container cap as claimed in claim 17 wherein one edge of said lid means is substantially co-linear with one edge of said second cover member; and wherein said tamper evidencing means is integral with said one edge of said lid means and at least part of said one edge of said second cover member;

said tamper evidencing means comprising an elongated bar member having at least one weakened zone along its length.

19. A tamper evidencing container cap, comprising:

first and second cover means of substantially the same length and width, said first cover member including a central, rectangular, ribbed flange extending from the upper surface thereof, said flange being shorter in length and width than said first cover member, and said second cover member including means for slidably engaging said ribbed flange; and tamper evidencing means removably connected to said first and second cover members to prevent said second cover member from opening until said tamper evidencing means is removed.

20. A tamper evidencing container cap as claimed in claim 19, said engaging means comprising a lower skirt extending from the periphery of said upper cover member, said lower skirt comprising a pair of opposed walls, a wall intermediate said opposed walls, and pairs of spaced apart ribs extending inwardly from said opposed walls.

21. A tamper evidencing container cap as claimed in claim 20, comprising further tamper evidencing means incorporated in said first cover member.

22. A tamper evidencing container cap as claimed in claim 21, wherein said further tamper evidencing means comprises a skirt extending from the periphery of said first cover member for engaging a side surface of the container, said skirt having a plurality of spaced apart weakened zones around its periphery.

23. A tamper evidencing container cap, comprising cover means, at least one lid pivotally connected to said cover means selectively movable between open and closed positions to selectively permit access to the contents of the container;

first tamper evidencing means connected between said cover means and lid to prevent said lid from opening;

second tamper evidencing means comprising a skirt extending from the periphery of said cover means for engaging a side surface of the container, said skirt having a plurality of spaced-apart weakened zones around its periphery.

24. A tamper evidencing container cap as claimed in claim 23 wherein said skirt comprises a horizontal portion extending outwardly from the periphery of said cover means and a vertical portion extending downwardly from the periphery of said horizontal portion;

said weakened zones incorporated in said horizontal portion of said skirt.

25. A tamper evidencing container cap as claimed in claim 24 wherein said weakened zones comprise elongated horizontal notches, said notches being substantially V-shaped in cross-section.

26. A tamper evidencing container cap as claimed in claim 23 wherein said skirt comprises a horizontal portion extending outwardly from the periphery of said cover means and a vertical portion extending downwardly from the periphery of said horizontal portion;

said weakened zones being incorporated in said vertical portion of said skirt.

27. A tamper evidencing container cap as claimed in claim 26 wherein said weakened zones comprise elongated, vertically disposed notches, said notches being substantially V-shaped in cross-section.

28. A tamper evidencing container cap as claimed in claim 23 wherein said skirt comprises a horizontal portion extending outwardly from the periphery of said cover means and a vertical portion extending downwardly from the periphery of said horizontal portion;

said weakened zones being incorporated in both said horizontal and said vertical portions of said skirt.

29. A tamper evidencing container cap as claimed in claim 28 wherein said weakened zones comprise elongated notches, said notches being substantially V-shaped in cross-section.

30. A tamper evidencing container cap as claimed in claim 29 wherein said weakened zones are disposed horizontally in said horizontal portion of said skirt and vertically in said vertical portion of said skirt.

* * * * *

UNITED STATES PATENT AND TRADEMARK OFFICE

CERTIFICATE OF CORRECTION

PATENT NO. : 4,592,480

DATED : 6/3/86

INVENTOR(S) : Hart et al

It is certified that error appears in the above-identified patent and that said Letters Patent are hereby corrected as shown below: On the title page, Item /75/ Inventors:

The name of Robert O. Lindstrom has been added as a joint inventor.

Signed and Sealed this

Eighteenth Day of November, 1986

*Attest:*

DONALD J. QUIGG

*Attesting Officer* *Commissioner of Patents and Trademarks*